US007761979B2

(12) United States Patent
Wang

(10) Patent No.: US 7,761,979 B2
(45) Date of Patent: Jul. 27, 2010

(54) COAXIAL CONNECTOR CRIMPING TOOL

(75) Inventor: Chih-Lang Wang, Tu Cheng (TW)

(73) Assignee: Hanlong Industrial Co., Ltd, Tu Cheng (TW)

( * ) Notice: Subject to any disclaimer, the term of this patent is extended or adjusted under 35 U.S.C. 154(b) by 288 days.

(21) Appl. No.: 11/869,045

(22) Filed: Oct. 9, 2007

(65) Prior Publication Data

US 2009/0011638 A1 Jan. 8, 2009

(30) Foreign Application Priority Data

Jul. 3, 2007 (TW) ..... 96210841 A

(51) Int. Cl.
*H01R 43/00* (2006.01)

(52) U.S. Cl. ..... 29/758; 29/751; 29/753; 29/408; 29/409; 29/14; 81/333; 81/363; 81/375; 72/480; 72/465.1; 72/468; 72/479; 72/473

(58) Field of Classification Search ..... 29/751–753, 29/408–409, 14, 21.6, 877; 72/343, 480, 72/465.1, 468, 479, 473, 462; 81/333, 363, 81/375, 490; *H01R 43/04*
See application file for complete search history.

(56) References Cited

U.S. PATENT DOCUMENTS

| | | | | | |
|---|---|---|---|---|---|
| 578,249 | A * | 3/1897 | Letteer | ..... | 81/356 |
| 2,691,911 | A * | 10/1954 | Gren | ..... | 81/356 |
| 7,299,542 | B2 * | 11/2007 | Montena | ..... | 29/751 |
| 2007/0234556 | A1 * | 10/2007 | Montena | ..... | 29/747 |

* cited by examiner

*Primary Examiner*—Derris H Banks
*Assistant Examiner*—Azm Parvez
(74) *Attorney, Agent, or Firm*—Alan Kamrath; Kamrath & Associates PA

(57) ABSTRACT

A coaxial connector crimping tool has a base, a handle, a transmittal unit and a crimping area. The base has a containment slot, and the containment slot has a guiding structure. One end of the handle is pivoted on an end of the base. Two ends of the transmittal unit are respectively pivoted on a first predetermined position of the guiding structure and a second predetermined position of the handle, and the transmittal unit has an adjustable length. The transmittal unit has an adjustable portion, and the adjustable portion is disposed between the first predetermined position and the second predetermined position. The crimping area is pivoted on the transmittal unit and disposed in the containment slot.

9 Claims, 4 Drawing Sheets

COAXIAL CONNECTOR CRIMPING TOOL

BACKGROUND OF THE INVENTION

1. Field of the Invention

The present invention relates to a coaxial connector crimping tool and, more particularly, to a coaxial connector crimping tool that may be used for crimping a terminal element.

2. Description of the Related Art

With prior art coaxial connector crimping tools, when a user needs to crimp different types of coaxial connectors (such as an F type coaxial connector or a BNC type coaxial connector) or needs to crimp the same type of coaxial connectors but with different standards (such as different lengths), different types of terminal crimping elements are required. Although there are some exchangeable coaxial connector crimping elements for different types or standards of coaxial connectors, there are also many different types of coaxial connectors. If each type of coaxial connector requires a matching coaxial connector crimping element, the expense can be considerable, as well as related storage problems arise.

The prior art coaxial connector crimping tool has a handle, a base and a transmittal shaft. One end of the handle is pivoted on one end of the base, and two ends of the transmittal shaft are respectively pivoted on predetermined positions on the handle and the base. With the above-mentioned structure, the handle, the base and the transmittal shaft form an interactive linking relationship. In the prior art, for a single crimping tool to be suitable for the same type of coaxial connectors with different lengths, both ends of the transmittal shaft are designed to be moveable. Please refer to FIG. 1. FIG. 1 shows a prior art coaxial connector crimping tool 100. In the coaxial connector crimping tool 100, one end 931 of a transmittal shaft 93 pivoted on the handle 92 is moved by rotating an adjusting element 94 of the handle 92 to make the end 931 of the transmittal shaft 93 slide along a slot 921 of the handle 92. Since the relative position of each element changes, when another end 932 of the transmittal shaft 93 pivoted on the base 95 slides along a slot 951 of the base 95, the distance between a coaxial connector crimping element 96 connected to another the other end 932 of the transmittal shaft 93 and one end 952 of the base 95 changes. Therefore, the same coaxial connector crimping element 96 can be used for crimping the same type of terminal having different lengths.

However, in this coaxial connector crimping tool 100, since the movement direction of the adjusting element 94 is along the direction of the handle 92, when the handle is pushed, the direction of its acting force is different from the axis direction of the transmittal shaft 93. Only a partial force is transferred to the transmittal shaft 93. Furthermore, this prior art structure causes uneven force applied on the transmittal shaft 93, which results in stress concentration on the transmittal shaft 93.

Therefore, it is desirable to provide a coaxial connector crimping tool to mitigate and/or obviate the aforementioned problems.

SUMMARY OF THE INVENTION

A main objective of the present invention is to provide a coaxial connector crimping tool with an adjustable transmittal shaft length.

Another objective of the present invention is to provide a coaxial connector crimping tool which can store coaxial connector crimping elements in its base.

Another objective of the present invention is to provide a coaxial connector crimping tool which has two layers of storage space in its base for coaxial connector crimping elements.

In order to achieve the above mentioned main objective, the coaxial connector crimping tool of the present invention comprises a base, a handle, a transmittal unit and a crimping area. The base has a containment slot, and the containment slot has a guiding structure. One end of the handle is pivoted on an end of the base. Two ends of the transmittal unit are respectively pivoted on a first predetermined position of the guiding structure and a second predetermined position of the handle, and the transmittal unit has an adjustable length. The transmittal unit has an adjustable portion, and the adjustable portion is disposed between the first predetermined position and the second predetermined position. The crimping area is pivoted on the transmittal unit and disposed in the containment slot.

In order to achieve another above mentioned objective, the base of the coaxial connector crimping tool comprises the first crimping element containment area and a second crimping element. The second crimping element is located inside of the first crimping containment area, and the second crimping element is used for storing at least one coaxial connector crimping element. for storing at least one coaxial connector crimping element.

In order to achieve another above mentioned objective, the base of the coaxial connector crimping tool comprises the first crimping element containment area and a second crimping element, the second crimping element is located inside of the first crimping containment area, the second crimping element is used for storing at least one coaxial connector crimping element.

According to the embodiment of the present invention, the transmittal unit has a first connecting element and a second connecting element. One end of the first connecting element is pivoted on the first predetermined position, and another end of the first connecting element is connected to one end of the adjustable portion. One end of the second connecting element is connected to another end of the adjustable portion, and another end of the second connecting element is pivoted on the second predetermined position. One end of the adjustable portion is a screw, and another end of the first connecting element has a tapped hole matching the screw.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
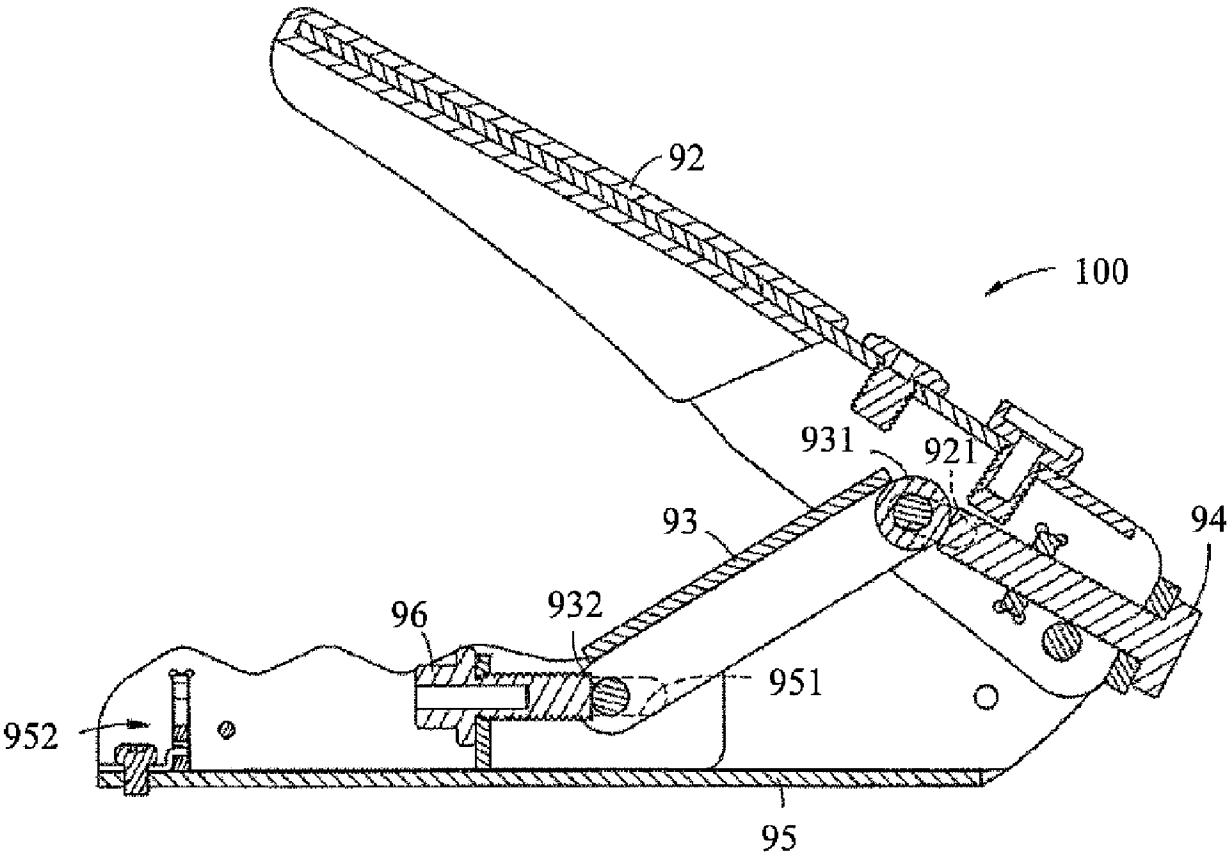
FIG. 1 (prior art)
FIG. 1 shows a prior art coaxial connector crimping tool.
Figure 2:
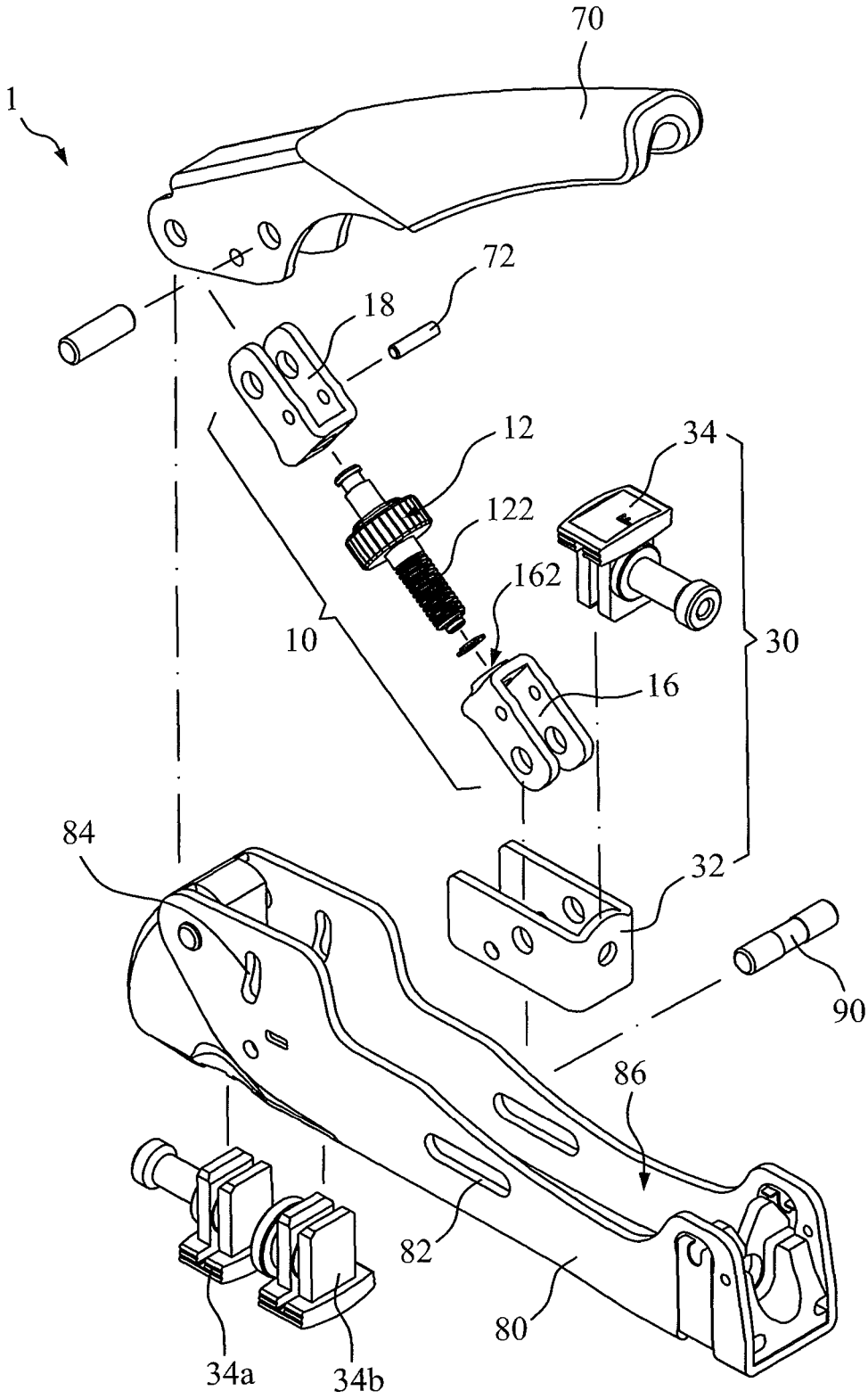
FIG. 2 is an exploded view of an embodiment of a coaxial connector crimping tool.
Figure 3:
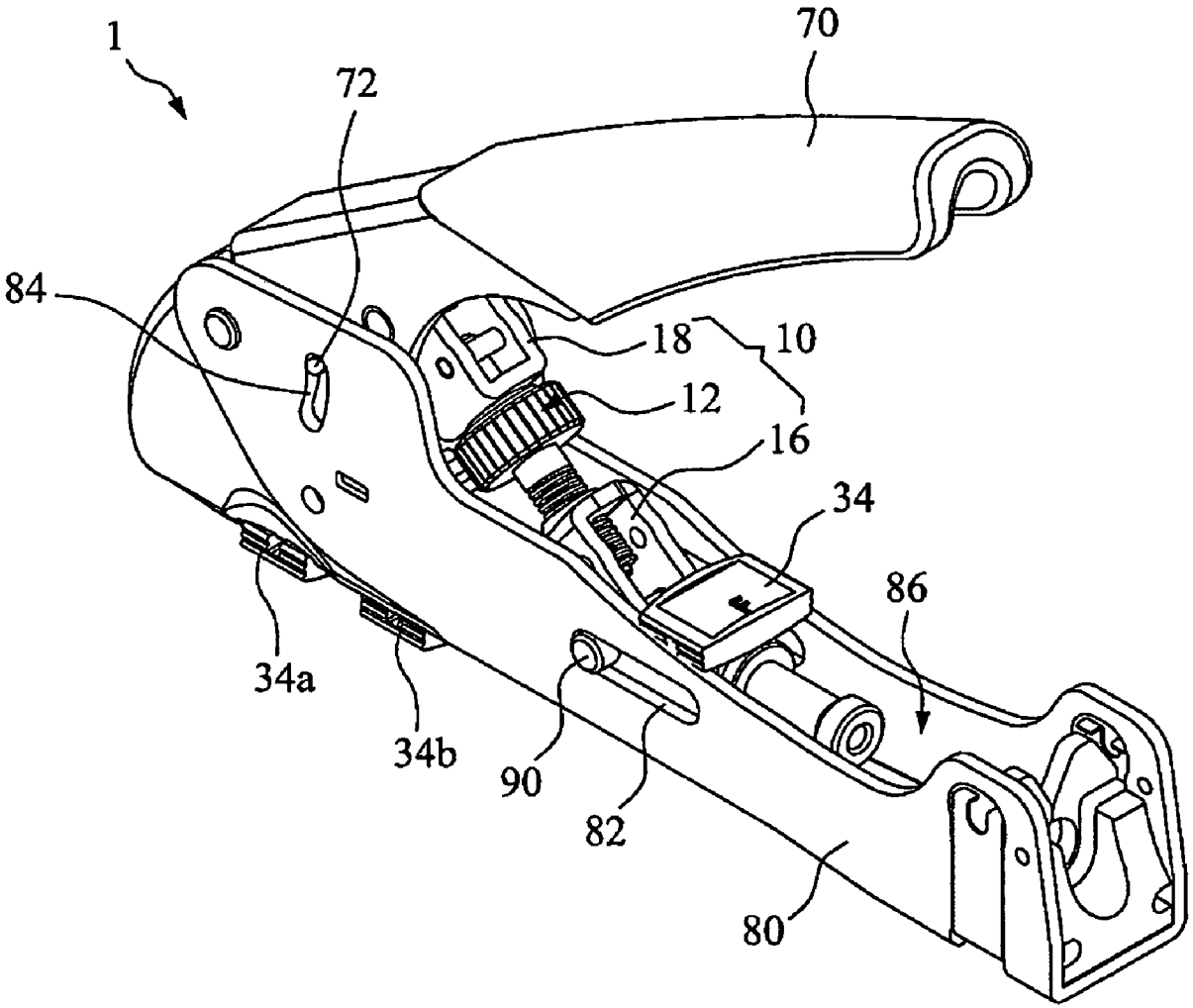
FIG. 3 is a perspective view of the embodiment of the coaxial connector crimping tool.

Please refer to FIG. 2 and FIG. 3. FIG. 2 is an exploded view of an embodiment coaxial of a connector crimping tool. FIG. 3 is a perspective view of the embodiment of the coaxial connector crimping tool. As shown in FIG. 2 and FIG. 3, a coaxial connector crimping tool 1 comprises a base 80, a handle 70, a transmittal unit 10 and a crimping area 30.

The base 80 comprises a containment slot 86, and a side face of the containment slot 86 has a guiding slot 82. When a user uses the coaxial connector crimping tool 1 to crimp coaxial connectors, he or she can place the base 80 on a flat surface.

One end of the handle 70 is pivoted on one end of the base 80, and another end of the handle 70 can be pushed by the user.

The transmittal unit 10 is used to transfer the force applied by the user, and the length of the transmittal unit 10 can be adjusted for differing requirements suitable for crimping differently sized coaxial connectors. Two ends of the transmittal unit 10 are respectively pivoted on a first predetermined position of the guiding slot 82 and a second predetermined position of the handle 70. The transmittal unit 10 has an adjustable portion 12, and the adjustable portion 12 is disposed between the first predetermined position of the guiding slot 82 and the second predetermined position of the handle 70.

The crimping area 30 is pivoted on one end of the transmittal unit 10 and disposed in the containment slot 86. While a rod 90 connected to the crimping area 30 slides in the guiding slot 82, the crimping area 30 moves in the containment slot 86. In this embodiment, the crimping area 30 comprises a sliding member 32 and a coaxial connector crimping element 34. The coaxial connector crimping element 34 can be swapped for other types of coaxial connector crimping elements.

In this embodiment, the transmittal unit 10 comprises an adjustable portion 12, a first connecting element 16 and a second connecting element 18. One end of the first connecting element 16 is pivoted on the first predetermined position of the guiding slot 82, and another end of the first connecting element 16 is connected to one end of the adjustable portion 12. One end of the second connecting element 18 is connected to another end of the adjustable portion 12, and another end of the second connecting element 18 is pivoted on the second predetermined position of the handle 70.

In this embodiment, one end of the adjustable portion 12 is a screw 122, and another end of the first connecting element 16 has a tapped hole 162 matching the screw 122. The matching screw 122 and the tapped hole 162 may be located at other positions. The screw 122 and the tapped hole 162 can be located on any two nearby elements of the transmittal unit 10. The following are three examples: the screw is disposed on another end of the first connecting element 16, and the tapped hole matching the screw is disposed on one end of the adjustable portion 12; the screw is disposed on another end of the adjustable portion 12, and the tapped hole matching the screw is disposed on one end of the second connecting element 18; and the screw is disposed on one end of the second connecting element 18, and the tapped hole matching the screw is disposed on another end of the adjustable portion 12.

In addition to the tapped hole that matches the screw, any adjustable structure that permits the transmittal unit 10 to change the total length of the transmittal unit 10 is within the gambit of the present invention. For example, the two nearby elements of the transmittal unit 10 may have matching ratchets which have a fixed pitch to provide the length adjustment capabilities for the transmittal unit 10.

The transmittal unit 10 does not require both the first connecting element 16 and the second connecting element 18. For example, the second connecting element 18 and the handle 70 may be integrated so that there is no independent second connecting element 18, and another end of the adjustable portion 12 may be directly pivoted on the second predetermined position.

In this embodiment, a side face of the base 80 comprises a positioning slot 84 and a positioning shaft 72 connected to the second connecting element 18 and capable of sliding in the positioning slot 84. Since the positioning shaft 72 is limited to the positioning slot 84, the positioning slot 84 limits the maximum angle between the handle 70 and the base 80. When the adjustable portion 12 moves, the angle between the handle 70 and the base 80 reaches the maximum angle, and the sliding member 32 is driven to slide in the guiding slot 82. If there is no positioning slot 84 and positioning shaft 72, when the adjustable portion 12 is moved, the angle between the handle 70 and the base 80 will continue to increase, and the sliding member 32 will then stay still.

Figure 4:
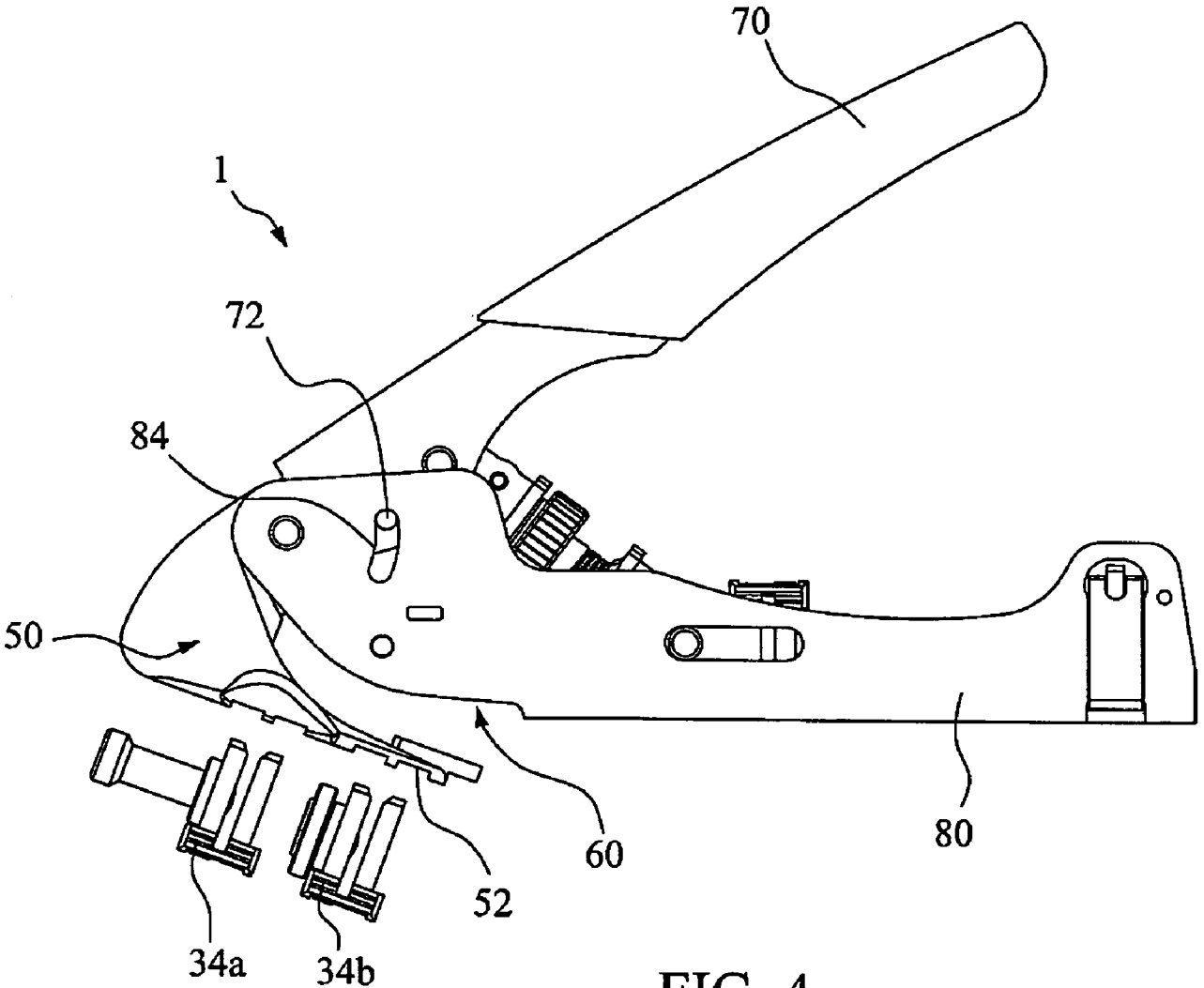
FIG. 4 is a side view of the embodiment of the coaxial connector crimping tool.

Please refer to FIG. 4. FIG. 4 is a side view of the embodiment of the coaxial connector crimping tool 1. In this embodiment, for using the space within the containment slot 86 of the coaxial connector crimping tool 1, the base 80 comprises a first crimping element containment area 50 for storing backup terminal crimping elements. The first crimping element containment area 50 comprises a containment hole 52, and at least one coaxial connector crimping element may pass through the containment hole 52 for fastening and storing in the first crimping element containment area 50. In this embodiment, the first crimping element containment area 50 can accept two coaxial connector crimping elements 34*a*, 34*b* for backup purposes. Please also refer to FIG. 3. The coaxial connector crimping element 34 can be pulled out to swap with the backup coaxial connector crimping elements 34*a*, 34*b* stored in the first crimping element containment area 50, which may crimp different types of coaxial connectors.

The coaxial connector crimping element 34 and the first crimping element containment area 50 can be connected in various ways. For example, the coaxial connector crimping element 34 can be wedged, clipped, magnetically fastened or screwed onto the first crimping element containment area 50.

To store more terminal crimping heads and completely use the space within the containment slot 86 of the coaxial connector crimping tool 1, the base 80 further comprises a second crimping element containment area 60 for storing backup terminal crimping elements. The second crimping element containment area 60 is located inside of the first crimping containment area 50. After the first crimping element containment area 50 is opened, the second crimping element containment area 60 can also be used for storing coaxial connector crimping elements. Therefore, both the first crimping element containment area 50 and the second crimping element containment area 60 provide two layers of storage space for coaxial connector crimping elements, which takes up most of the space within the containment slot 86. In this embodiment, the first crimping element containment area 50 is pivoted on the base 80. Thus, the first crimping element containment area 50 can be opened to store or take out the coaxial connector crimping element of the second crimping element containment area 60.

Please refer again to FIG. 2 and FIG. 3 for an explanation of the movement of the coaxial connector crimping tool 1. When the coaxial connector crimping tool 1 uses the coaxial connector crimping element 34 to crimp together coaxial cables and the same type of coaxial connectors (such as an F type coaxial connector) but with different lengths, the user only needs to move the adjustable portion 12 of the transmittal unit 10. With the structural relationship between the screw 122 and the tapped hole 162, the total length of the transmittal unit 10 can be changed. When the user rotates the adjustable portion 12 to increase the total length of the transmittal unit 10, the transmittal unit 10 drives the crimping area 30 to move right, and the same coaxial connector crimping element 34 can be used for crimping shorter coaxial connectors. On the other hand, when the user rotates the adjustable portion 12 to reduce the total length of the transmittal unit 10, the transmittal unit 10 drives the crimping area 30 to move left, and the same coaxial connector crimping element 34 can be used for crimping longer coaxial connectors. Therefore, the coaxial connector crimping tool 1 of the present invention is suitable for differently sized terminal crimping elements.

Although the present invention has been explained in relation to its preferred embodiment, it is to be understood that many other possible modifications and variations can be made without departing from the spirit and scope of the invention as hereinafter claimed.

What is claimed is:

1. A coaxial connector crimping tool comprising:

a base having a containment slot, with the containment slot having a guiding structure;

a handle, with one end of the handle pivoted on one end of the base;

a transmittal unit having an adjustable length, with two ends of the transmittal unit being respectively pivoted on a first predetermined position of the guiding structure and a second predetermined position of the handle, wherein the transmittal unit comprises:

an adjustable portion disposed between the first predetermined position and the second predetermined position; and a crimping area pivoted relative the transmittal unit and disposed in the containment slot, wherein the transmittal unit further comprises a first connecting element, with one end of the first connecting element pivoted on the first predetermined position, with another end of the first connecting element connected to one end of the adjustable portion, wherein another end of the adjustable portion is pivoted on the second predetermined position, wherein the one end of the adjustable portion is a screw, and wherein the other end of the first connecting element has a tapped hole matching the screw.

2. The coaxial connector crimping tool as claimed in claim 1, wherein the guiding structure is a guiding slot, and wherein the guiding slot is disposed on one side face of the containment slot.

3. The coaxial connector crimping tool as claimed in claim 1, wherein the side face of the base further comprises a positioning slot, and wherein the positioning slot limits a maximum angle between the handle and the base.

4. The coaxial connector crimping tool as claimed in claim 1, wherein the base further comprises a first crimping element containment area, and wherein the first crimping element containment area is used for containing at least one coaxial connector crimping element.

5. The coaxial connector crimping tool as claimed in claim 4, wherein the coaxial connector crimping element is wedged, clipped, magnetically fastened or screwed onto the first crimping element containment area.

6. The coaxial connector crimping tool as claimed in claim 4, wherein the first crimping element containment area is pivoted on the base.

7. The coaxial connector crimping tool as claimed in claim 4, wherein the base further comprises a second crimping element containment area, with the second crimping element containment area located inside of the first crimping containment area, with the second crimping element containment area used for containing at least one coaxial connector crimping element.

8. A coaxial connector crimping tool comprising:

a base having a containment slot, with the containment slot having a guiding structure;

a handle, with one end of the handle pivoted on one end of the base;

a transmittal unit having an adjustable length, with two ends of the transmittal unit being respectively pivoted on a first predetermined position of the guiding structure and a second predetermined position of the handle, wherein the transmittal unit comprises:

an adjustable portion disposed between the first predetermined position and the second predetermined position; and a crimping area pivoted relative the transmittal unit and disposed in the containment slot, wherein the transmittal unit further comprises:

a first connecting element, with one end of the first connecting element pivoted on the first predetermined position, with another end of the first connecting element connected to one end of the adjustable portion; and a second connecting element, with one end of the second connecting element connected to another end of the adjustable portion, with another end of the second connecting element pivoted on the second predetermined position, wherein the one end of the adjustable portion is a screw, and wherein the other end of the first connecting element has a tapped hole matching the screw.

9. A coaxial connector crimping tool comprising:

a base having a containment slot, with the containment slot having a guiding structure;

a handle, with one end of the handle pivoted on one end of the base;

a transmittal unit having an adjustable length, with two ends of the transmittal unit being respectively pivoted on a first predetermined position of the guiding structure and a second predetermined position of the handle, wherein the transmittal unit comprises:

an adjustable portion disposed between the first predetermined position and the second predetermined position; and a crimping area pivoted relative the transmittal unit and disposed in the containment slot, wherein the transmittal unit further comprises:

a first connecting element, with one end of the first connecting element pivoted on the first predetermined position, with another end of the first connecting element connected to one end of the adjustable portion; and a second connecting element, with one end of the second connecting element connected to another end of the adjustable portion, with another end of the second connecting element pivoted on the second predetermined position, wherein the other end of the adjustable portion is a screw, and wherein the one end of the second connecting element has a tapped hole matching the screw.

* * * * *